US011713868B1

(12) United States Patent
Chen

(10) Patent No.: US 11,713,868 B1
(45) Date of Patent: Aug. 1, 2023

(54) LIGHT EMITTING DEVICE AND LIGHT-EMITTING CONNECTING LINE

(71) Applicant: DONGGUAN XINGYANG TECHNOLOGY CO., LTD., Dongguan (CN)

(72) Inventor: Weixing Chen, Dongguan (CN)

(73) Assignee: DONGGUAN XINGYANG TECHNOLOGY CO., LTD., Dongguan (CN)

( * ) Notice: Subject to any disclaimer, the term of this patent is extended or adjusted under 35 U.S.C. 154(b) by 0 days.

(21) Appl. No.: 17/683,381

(22) Filed: Mar. 1, 2022

(30) Foreign Application Priority Data

Feb. 18, 2022 (CN) ..... 202220333475.2

(51) Int. Cl.

| | |
|---|---|
| ***F21V 19/00*** | (2006.01) |
| ***F21V 23/06*** | (2006.01) |
| ***F21S 4/28*** | (2016.01) |
| *F21Y 115/10* | (2016.01) |

(52) U.S. Cl.
CPC ..... *F21V 19/004* (2013.01); *F21S 4/28* (2016.01); *F21V 23/06* (2013.01); *F21Y 2115/10* (2016.08)

(58) Field of Classification Search
CPC ..... F21V 19/004; F21V 23/06; F21S 4/28; F21Y 2115/10
See application file for complete search history.

(56) References Cited

U.S. PATENT DOCUMENTS 10,288,237 B2 * 5/2019 Li ..... F21V 19/004

FOREIGN PATENT DOCUMENTS

| | | | | |
|---|---|---|---|---|
| CN | 104879715 A | * | 9/2015 | ..... F21K 9/00 |
| CN | 206522649 U | * | 9/2017 | |
| CN | 108050495 A | * | 5/2018 | |
| CN | 213237422 U | * | 5/2021 | |
| FR | 2982928 A1 | * | 5/2013 | ..... F21K 9/20 |
| FR | 3040465 A3 | * | 3/2017 | |

* cited by examiner

*Primary Examiner* — Jong-Suk (James) Lee
*Assistant Examiner* — Glenn Zimmerman
(74) *Attorney, Agent, or Firm* — Daniel M. Cohn; Howard M. Cohn

(57) ABSTRACT

The present invention discloses a light emitting device and a light-emitting connecting line. The light emitting device includes an LED light strip, a first clamping seat, a first light strip fixing pressing sheet, a second clamping seat and a second light strip fixing pressing sheet, the first clamping seat of the light emitting device may be clamped on a plug of a connecting harness or one end of cables of the connecting harness, and the second clamping seat may be clamped on the other ends of the cables of the connecting harness. According to the present invention, the LED light strip is convenient to mount and dismount, and after the light emitting device is assembled with the connecting harness via the two clamping seats, the connecting harness can achieve a colorful light emitting effect.

19 Claims, 9 Drawing Sheets

LIGHT EMITTING DEVICE AND LIGHT-EMITTING CONNECTING LINE

TECHNICAL FIELD

The present invention relates to the technical field of computer connecting lines, in particular to a light emitting device and a light-emitting connecting line.

BACKGROUND ART

In a computer case, a connecting line (also called an extension line and a data line) may be adopted to connect a mainboard and a display card or other parts. In order to improve the aesthetics of the computer case and meet individual demands of users, a light emitting device may be additionally mounted on the connecting line. After being energized, a light strip of the light emitting device is capable of emitting light with different colors so as to be colorful. However, a light strip of an existing light emitting device is fixed together with line clamping seats at two ends in a manner of fixation by using, for example, glue so as not to be dismounted, and if the light strip is forcedly dismounted, the light strip may be damaged and cannot be restored. In addition, it is inconvenient to assemble the existing light emitting device and the connecting line.

SUMMARY OF THE INVENTION

The purpose of the present invention is to provide a light emitting device and a light-emitting connecting line so as to overcome the above-mentioned defects in the prior art.

In order to achieve the above-mentioned purpose, the first aspect of the present invention provides a light emitting device, including:

an LED light strip used for emitting light after being energized;

a first clamping seat, wherein a first light strip insertion slot is formed in a part, facing one end of the LED light strip, of the first clamping seat, and one end of the LED light strip is inserted to the inside of the first clamping seat from the first light strip insertion slot;

a first light strip fixing pressing sheet, wherein the first light strip fixing pressing sheet is locked on the first clamping seat by using a first screw and is located on the back of the LED light strip, and the first light strip fixing pressing sheet is matched with the inner top wall of the first clamping seat to tightly press one end of the LED light strip, so that one end of the LED light strip is fixedly connected with the first clamping seat;

a second clamping seat, wherein a second light strip insertion slot is formed in a part, facing one end of the LED light strip, of the second clamping seat, and the other end of the LED light strip is inserted to the inside of the second clamping seat from the second light strip insertion slot; and a second light strip fixing pressing sheet, wherein the second light strip fixing pressing sheet is locked on the second clamping seat by using a second screw and is located on the back of the LED light strip, and the second light strip fixing pressing sheet is matched with the inner top wall of the second clamping seat to tightly press the other end of the LED light strip, so that the other end of the LED light strip is fixedly connected with the second clamping seat.

The inward surface of the first light strip fixing pressing sheet is provided with several first line pressing convex bodies which are upwards raised, the inner top wall of the first clamping seat is provided with several second line pressing convex bodies which are downwards raised.

The inward surface of the second light strip fixing pressing sheet is provided with several third line pressing convex bodies which are upwards raised, the inner top wall of the second clamping seat is provided with several fourth line pressing convex bodies which are downwards raised.

The first clamping seat comprises a first clamping seat body and first clamping seat buckling legs, the first clamping seat buckling legs are connected to the bottoms of two sides of the first clamping seat body, and the inner surface of each of the first clamping seat buckling legs is provided with a buckling position buckled with one of plugs of a connecting harness.

The first clamping seat comprises a first clamping seat body, first clamping seat buckling legs and a first line splitting and clamping device for clamping cables of the connecting harness, wherein the first clamping seat buckling legs are connected to the bottoms of two sides of the first clamping seat body, the inner surface of each of the first clamping seat buckling legs is provided with a first clamping position, the lower end of the first line splitting and clamping device is provided with several first line clamping blocks arranged in a length direction of the first line splitting and clamping device, a first line clamping slot for clamping the cables of the connecting harness is formed between every two of the adjacent first line clamping blocks, a first clamping position slot is formed in the bottom of each of the first line clamping blocks at two sides of the first line splitting and clamping device, and the first clamping positions of the first clamping seat buckling legs are clamped into the corresponding first clamping position slots, so that the first line splitting and clamping device is mounted between the two first clamping seat buckling legs and is located on the back of the LED light strip.

The second clamping seat comprises a second clamping seat body, second clamping seat buckling legs and a second line splitting and clamping device for clamping the cables of the connecting harness, wherein the second clamping seat buckling legs are connected to the bottoms of two sides of the second clamping seat body, the inner surface of each of the second clamping seat buckling legs is provided with a second clamping position, the lower end of the second line splitting and clamping device is provided with several second line clamping blocks arranged in a length direction of the second line splitting and clamping device, a second line clamping slot for clamping the cables of the connecting harness is formed between every two of the adjacent second line clamping blocks, a second clamping position slot is formed in the bottom of each of the second line clamping blocks at two sides of the second line splitting and clamping device, and the second clamping positions of the second clamping seat buckling legs are clamped into the corresponding second clamping position slots, so that the second line splitting and clamping device is mounted between the two second clamping seat buckling legs and is located on the back of the LED light strip.

A circuit board is arranged in the second clamping seat, a connection point of the LED light strip is electrically connected with the circuit board, a wire protrusion opening is formed in the surface of the end, away from the LED light strip, of the second clamping seat, and the circuit board is connected with a wire protruding out of the wire protrusion opening of the second clamping seat.

The light emitting device comprising a middle line splitting and clamping device located on the back of the LED light strip, wherein the lower end of the middle line splitting and clamping device is provided with several third line clamping blocks arranged in a length direction of the middle line splitting and clamping device, a third line clamping slot for clamping the cables of the connecting harness is formed between every two of the adjacent third line clamping blocks, hanging buckles are respectively arranged on two sides of the upper end of the middle line splitting and clamping device, and the hanging buckles on the two sides of the middle line splitting and clamping device are movably buckled on two sides of the top of the LED light strip.

At least one LED light strip is provided, the LED light strip is set as a square silicon light strip.

Each LED light strip comprises a light strip housing, at least one light conductor and at least one light strip flexible circuit board with an LED wick, the light strip flexible circuit board is located inside the light strip housing, the light conductor is connected with the light strip housing and covers the outside of the light strip flexible circuit board, and a light shielding strip facing the light strip flexible circuit board is arranged outside the light conductor.

A second aspect of the present invention provides a light-emitting connecting line including at least one group of connecting harness and the light emitting device mentioned in the above-mentioned technical solution, wherein the connecting harness includes plugs and several cables, the plugs are connected to two ends of the cables, the first clamping seat of the light emitting device is clamped on one of the plugs of the connecting harness or one end of the cables of the connecting harness, and the second clamping seat of the light emitting device is clamped on the other ends of the cables of the connecting harness.

The connecting harness is provided with cables arranged up and down in two rows, and the cables are set as cables with silicon outer layers.

Compared with the prior art, the present invention has the beneficial effects:

1. the two ends of the LED light strip of the light emitting device provided by the present invention are pressed and fixed in the clamping seats respectively by the light strip fixing pressing sheets, so that it is convenient to mount and dismount the LED light strip; and after the light emitting device is assembled with the connecting harness via the two clamping seats, the connecting harness can achieve a colorful light emitting effect; and 2. one of the clamping seats of the light emitting device provided by the present invention can be clamped on one of the plugs of the connecting harness or one end of the cables of the connecting harness, the other clamping seat can be clamped on the other ends of the cables of the connecting harness, and therefore, compared with an existing light emitting device adopting mortise and tenon connection, it is more convenient to assemble the light emitting device provided by the present invention and the connecting harness, and the efficiency is increased.

DETAILED DESCRIPTION OF THE INVENTION

Embodiment 1

Figure 1:
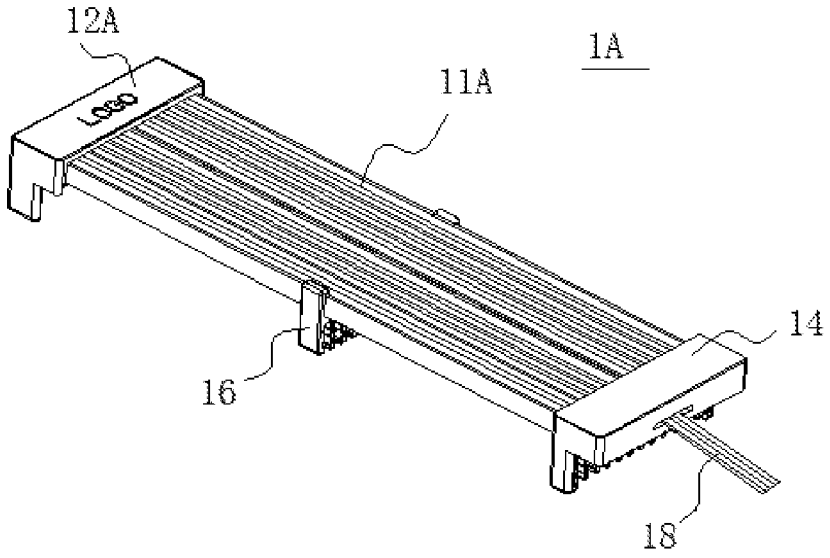
FIG. 1 is a first schematic diagram showing a structure of a first light emitting device.
Figure 2:
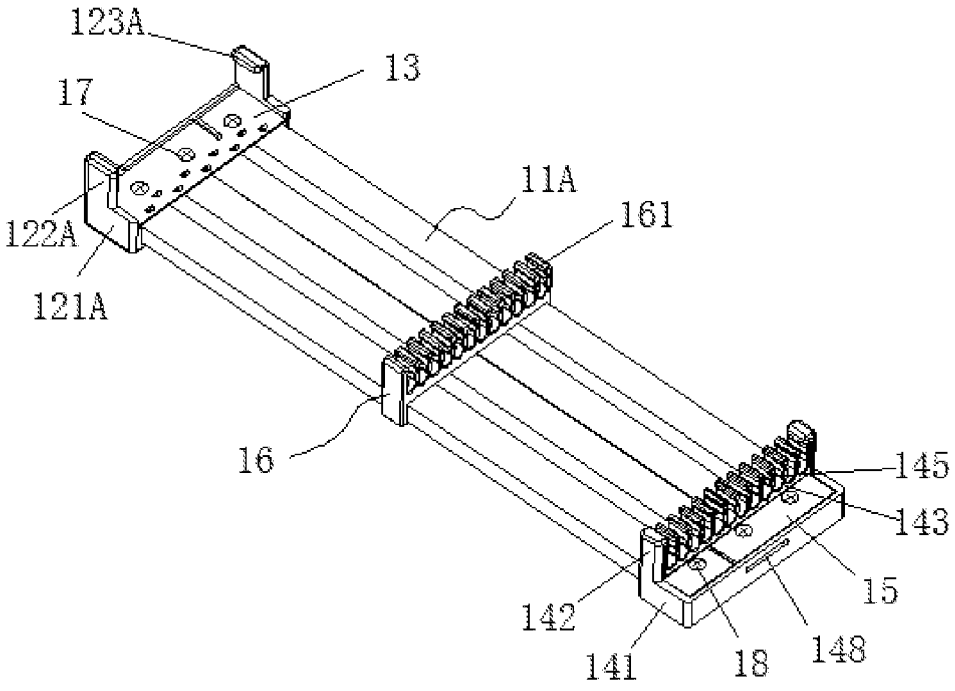
FIG. 2 is a second schematic diagram showing the structure of the first light emitting device.

Reference is made to FIG. 1 and FIG. 2, the embodiment 1 of the present invention provides a light emitting device 1A including components such as an LED light strip 11A, a first clamping seat 12A, a first light strip fixing pressing sheet 13, a second clamping seat 14 and a second light strip fixing pressing sheet 15, and all the components in the present embodiment will be described in detail below in conjunction with the accompanying drawings.

Figure 3:
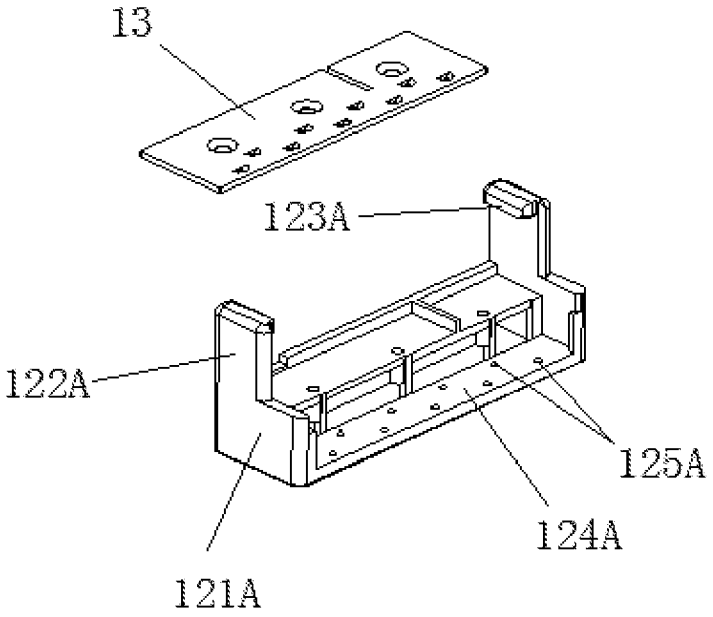
FIG. 3 is an exploded view showing a part at one end of the first light emitting device.

As shown in FIG. 2 and FIG. 3, the first clamping seat 12A includes a first clamping seat body 121A and first clamping seat buckling legs 122A, the first clamping seat buckling legs 122A are connected to the bottoms of two sides of the first clamping seat body 121A, and the inner surface of each of the first clamping seat buckling legs 122A is provided with a buckling position 123A buckled with one of plugs of a connecting harness 2. A first light strip insertion slot 124A is formed in a part, facing one end of the LED light strip 11A, of the first clamping seat body 121A, and one end of the LED light strip 11A is inserted to the inside of the first clamping seat body 121A from the first light strip insertion slot 124A.

As shown in FIG. 2 and FIG. 3, the first light strip fixing pressing sheet 13 is locked on the first clamping seat 12A by using a first screw 17 and is located on the back of the LED light strip 11A, and the first light strip fixing pressing sheet 13 is matched with the inner top wall of the first clamping seat 12A to tightly press one end of the LED light strip 11A, so that one end of the LED light strip 11A is fixedly connected with the first clamping seat 12A. The first light strip fixing pressing sheet 13 may be set as a metal sheet.

In order to improve the pressing degree of the first light strip fixing pressing sheet 13 and the first clamping seat 12A to the LED light strip 11A, the inward surface, in contact with the LED light strip 11A, of the first light strip fixing pressing sheet 13 may be provided with several first line pressing convex bodies 131 which are upwards raised, the first line pressing convex bodies 131 may be set to be shaped like a semicircular arc provided with a backstop surface perpendicular to the first light strip fixing pressing sheet 13, and thus, the structures of the first line pressing convex bodies 131 are conveniently impact-molded on the first light strip fixing pressing sheet 13; and the inner top wall of the first clamping seat 12A may be provided with several second line pressing convex bodies 125A which are downwards raised, the second line pressing convex bodies 125A may be set to be shaped like a frustum, and the first line pressing convex bodies 131 and the second line pressing convex bodies 125A may tightly press the LED light strip 11A so as to have backstop and fixation effects.

Figure 4:
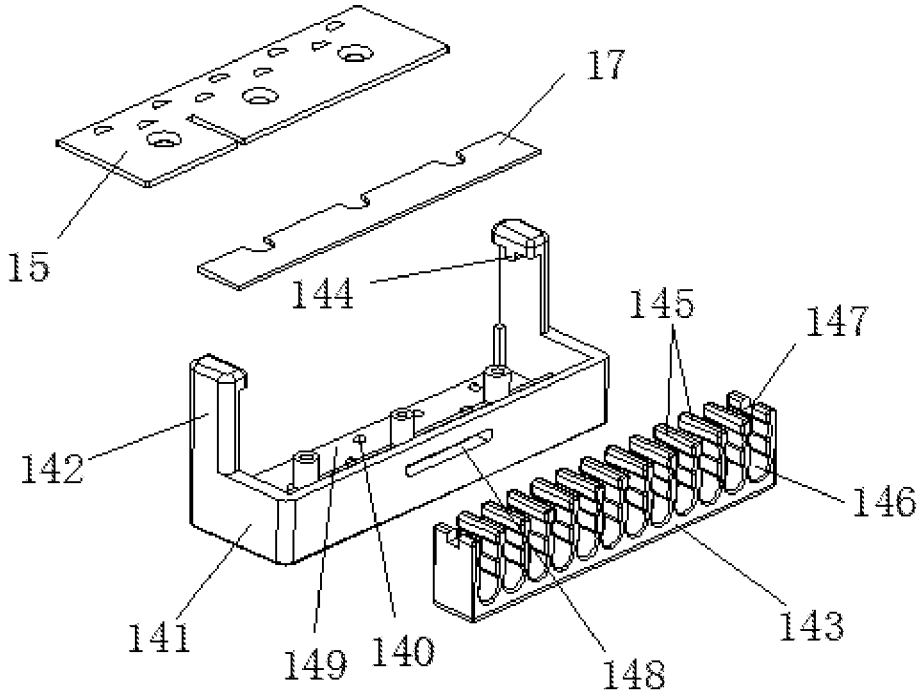
FIG. 4 is an exploded view showing a part at the other end of the first light emitting device.
Figure 5:
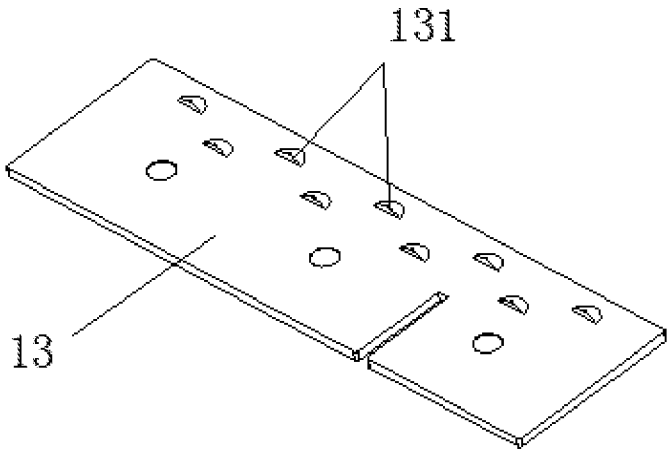
FIG. 5 is a schematic diagram showing a structure of a first light strip fixing pressing sheet.

As shown in FIG. 2 and FIG. 4, the second clamping seat 14 includes a second clamping seat body 141, second clamping seat buckling legs 142 and a second line splitting and clamping device 143 for clamping the cables 21 of the connecting harness 2, wherein the second clamping seat buckling legs 142 are connected to the bottoms of two sides of the second clamping seat body 141, the inner surface of each of the second clamping seat buckling legs 142 is provided with a second clamping position 144, the lower end of the second line splitting and clamping device 143 is provided with several second line clamping blocks 145 arranged in a length direction of the second line splitting and clamping device, a second line clamping slot 146 for clamping the cables 21 of the connecting harness 2 is formed between every two of the adjacent second line clamping blocks 145, a second clamping position slot 147 is formed in the bottom of each of the second line clamping blocks 145 at two sides of the second line splitting and clamping device 143, and the second clamping positions 144 of the second clamping seat buckling legs 142 are clamped into the corresponding second clamping position slots 147, so that the second line splitting and clamping device 143 is mounted between the two second clamping seat buckling legs 142 and is located on the back of the LED light strip 11A.

A second light strip insertion slot 149 is formed in a part, facing one end of the LED light strip 11A, of the second clamping seat body 141, and the other end of the LED light strip 11A is inserted to the inside of the second clamping seat body 141 from the second light strip insertion slot 149.

As shown in FIG. 2 and FIG. 4, the second light strip fixing pressing sheet 15 is locked on the second clamping seat 14 by using a second screw 18 and is located on the back of the LED light strip 11A, and the second light strip fixing pressing sheet 15 is matched with the inner top wall of the second clamping seat 14 to tightly press the other end of the LED light strip 11A, so that the other end of the LED light strip 11A is fixedly connected with the second clamping seat 14. The second light strip fixing pressing sheet 15 may be set as a metal sheet.

In order to improve the pressing degree of the second light strip fixing pressing sheet 15 and the second clamping seat 14 to the LED light strip 11A; the inward surface of the second light strip fixing pressing sheet 15 is provided with several third line pressing convex bodies which are upwards raised, and the structures of the third line pressing convex bodies may be the same as the structures of the first line pressing convex bodies 131 of the first light strip fixing pressing sheet 13; and the inner top wall of the second clamping seat 14 is provided with several fourth line pressing convex bodies 140 which are downwards raised, and the structures of the fourth line pressing convex bodies 140 may be the same as the structures of the second line pressing convex bodies 125A of the first light strip fixing pressing sheet 13. The third line pressing convex bodies and the fourth line pressing convex bodies may tightly press the LED light strip 11A so as to have backstop and fixation effects.

As shown in FIG. 1 and FIG. 4, a circuit board 17 may be further arranged in the second clamping seat 14, a connection point of the LED light strip 11A may be electrically connected with the circuit board 17, a wire protrusion opening 148 is formed in the surface of the end, away from the LED light strip 11A, of the second clamping seat 14, and the circuit board 17 is connected with a wire 18 protruding out of the wire protrusion opening 148 of the second clamping seat 14. The wire 18 may be connected with a mainboard to supply power to the LED light strip 11A.

Figure 6:
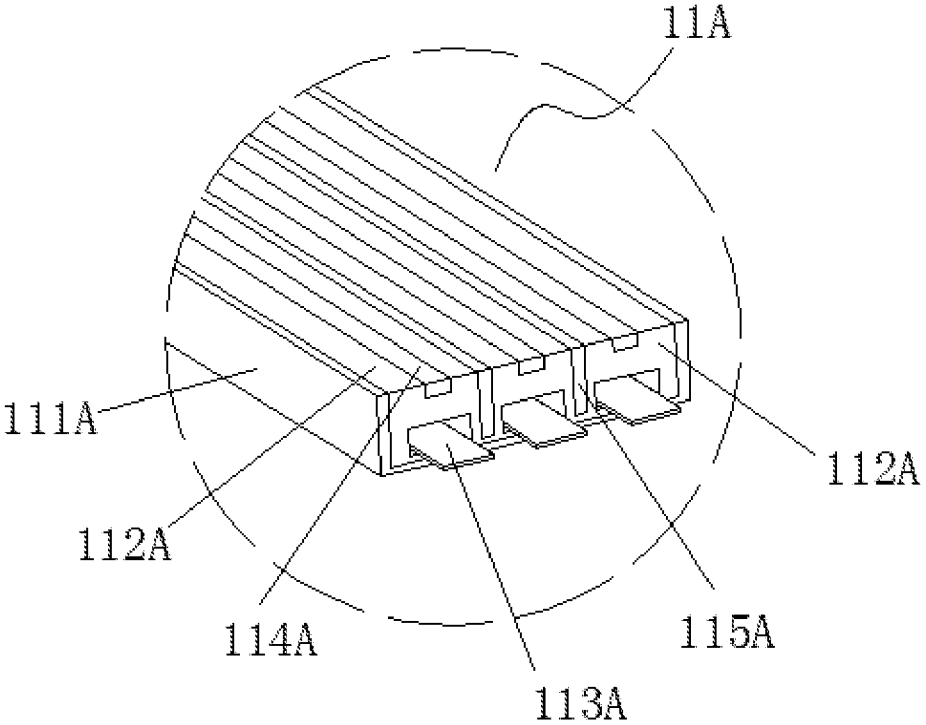
FIG. 6 is a partial enlarged view of a first LED light strip.

As shown in FIG. 1 and FIG. 2, two LED light strips 11A may be preferably arranged in the present embodiment, and the LED light strips 11A are set as square silicon light strips. As shown in FIG. 6, each of the LED light strips 11A may include a light strip housing 111A, three light conductors 112A and three light strip flexible circuit board 113A with LED wicks, the three light strip flexible circuit boards 113A are mounted inside the light strip housing 111A at equal intervals, the three light conductors 112A are connected in parallel to the inside of the light strip housing 111A and are connected with the light strip housing 111A, the three light conductors 112A respectively cover the outsides of the light strip flexible circuit boards 113A respectively corresponding to the light conductors, light shielding strips 114A facing the corresponding light strip flexible circuit boards 113A are arranged on middle positions outside all the light conductors, and spaced light shielding blocks 115A may be arranged among the three light conductors 112A. The LED light strips 11A in the present embodiment are combined LED light strips.

During work, the LED light strips 11A may emit rays with single or more colors after being energized, and the LED wicks are set as RGB wicks.

Figure 7:
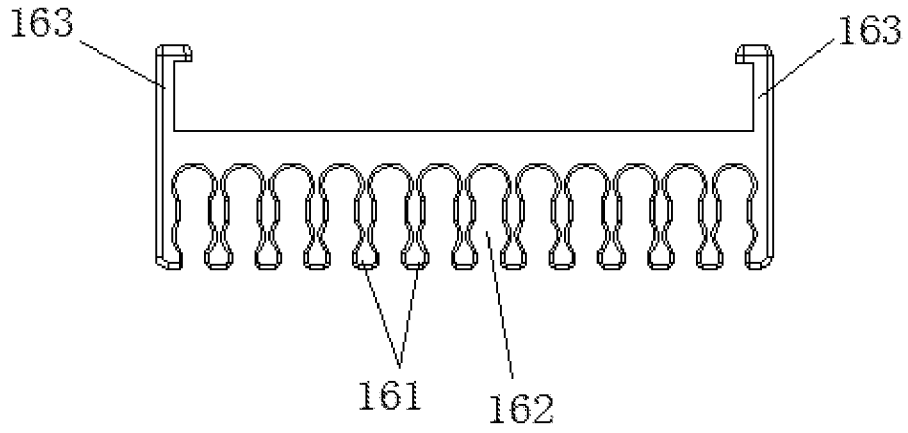
FIG. 7 is a schematic diagram showing a structure of a middle line splitting and clamping device.

As shown in FIG. 1, FIG. 2 and FIG. 7, a middle line splitting and clamping device 16 may be arranged on the back of the LED light strip, the lower end of the middle line splitting and clamping device 16 is provided with several third line clamping blocks 161 arranged in a length direction of the middle line splitting and clamping device, a third line clamping slot 162 for clamping the cables 21 of the connecting harness 2 is formed between every two of the adjacent third line clamping blocks 161, hanging buckles 163 are respectively arranged on two sides of the upper end of the middle line splitting and clamping device 16, the hanging buckles 163 on the two sides of the middle line splitting and clamping device 16 are movably buckled on two sides of the top of the LED light strip 11A, and the middle line splitting and clamping device 16 may move on the LED light strip 11A to adjust the position. The middle line splitting and clamping device 16 has effects of clamping and fixing lines and combing the cables.

In the present embodiment, each of the second clamping position slot 147 and the third line clamping slot 162 consists of two groups of slot positions (such as a C-shaped slot) so as to adapt to the cables 21, arranged up and down in two rows, of the connecting harness 2. Of course, the slot positions of the second clamping position slot 147 and the third line clamping slot 162 may be adjusted according to the number of the cables of the connecting harness 2.

Embodiment 2

Figure 8:
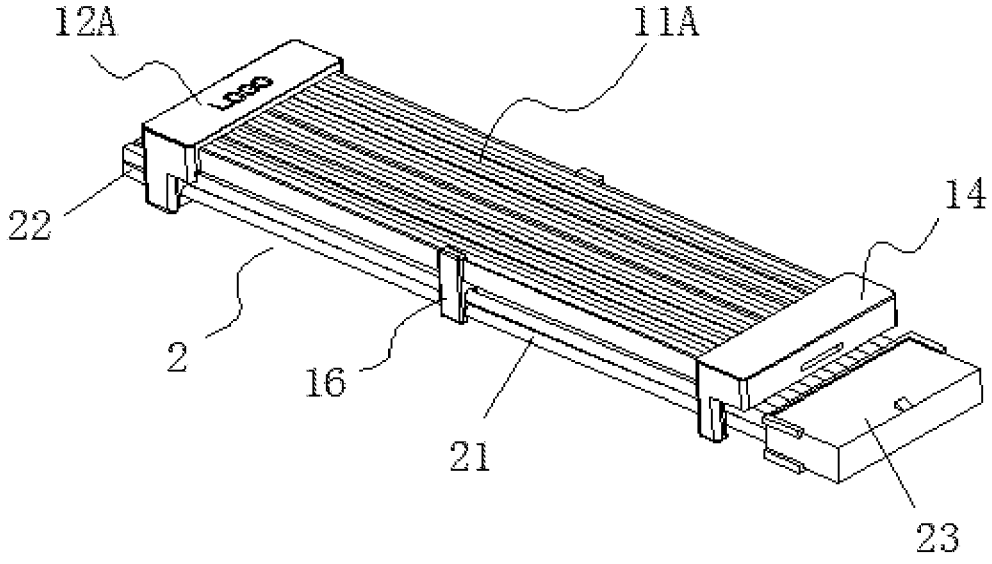
FIG. 8 is a first schematic diagram showing a structure of a first light-emitting connecting line.
Figure 9:
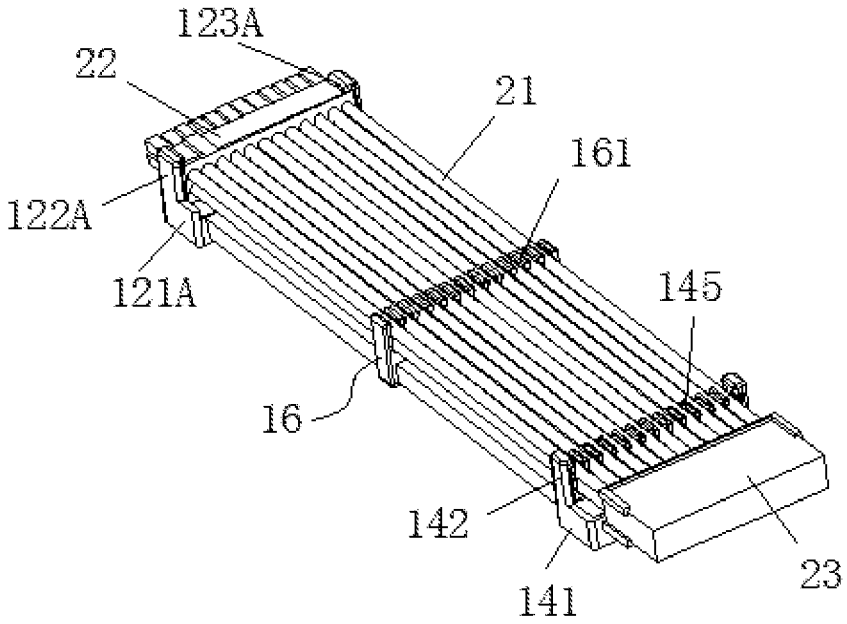
FIG. 9 is a second schematic diagram showing the structure of the first light-emitting connecting line.

Reference is made to FIG. 8 and FIG. 9, the embodiment 2 of the present invention provides a light-emitting connecting line including a group of connecting harness 2 and the light emitting device 1A in above embodiment 1. The connecting harness 2 may include a plug 22, a plug 23 and several cables 21, and the plug 22 and the plug 23 are respectively connected to two ends of the cables 21. The buckling position 123A of the first clamping seat 12A of the light emitting device 1A is directly clamped on the plug 22 of the connecting harness 2, and the second line splitting and clamping device 143 of the second clamping seat 14 of the light emitting device 1A is clamped on the other ends of the cables 21 of the connecting harness 2.

In the present embodiment, the cables 21 of the connecting harness 2 may be arranged up and down in two rows, and the cables 21 are preferably set as cables 21 with silicon outer layers. The cables are easy to bend, high in pressing resistance and aging resistance, good in insulation property and capable of reaching the food grade.

Embodiment 3

Figure 10:
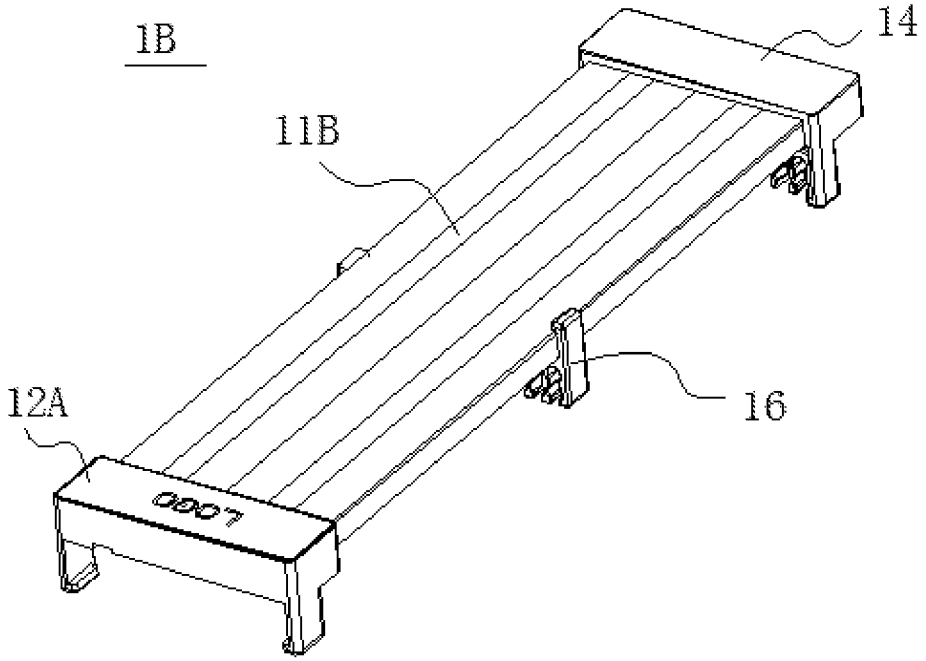
FIG. 10 is a schematic diagram showing a structure of a second light emitting device.
Figure 11:
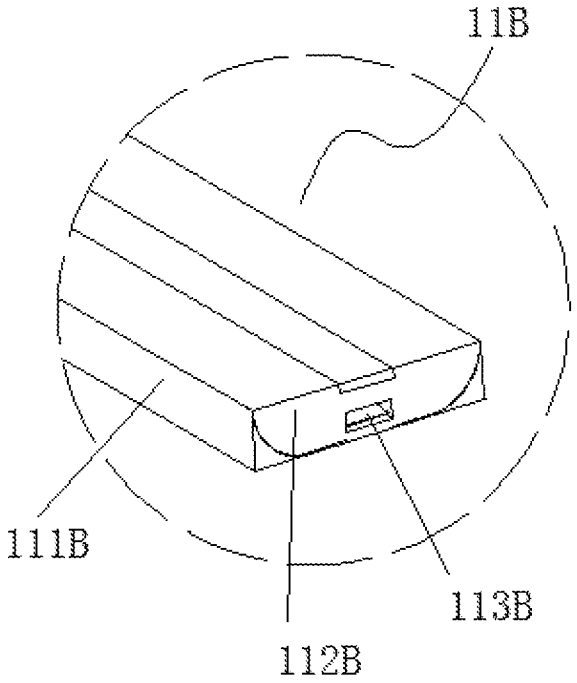
FIG. 11 is a partial enlarged view of a second LED light strip.

Reference is made to FIG. 10, the embodiment 3 of the present invention provides a light emitting device 1B including components such as an LED light strip 11B, a first clamping seat 12A, a first light strip fixing pressing sheet 13, a second clamping seat 14, a second light strip fixing pressing sheet 15 and a middle line splitting and clamping device 16. The structures and principles of the first clamping seat 12A, the first light strip fixing pressing sheet 13, the second clamping seat 14, the second light strip fixing pressing sheet 15 and the middle line splitting and clamping device 16 of the light emitting device 1B in the present embodiment 3 are the same as the structures and principles of the first clamping seat 12A, the first light strip fixing pressing sheet 13, the second clamping seat 14, the second light strip fixing pressing sheet 15 and the middle line splitting and clamping device 16 of the light emitting device 1A in the above-mentioned embodiment 1, except that, as shown in FIG. 11, the LED light strip 11B only includes a light strip housing 111B, a light conductor 112B and a light strip flexible circuit board 113B with an LED wick. The LED light strip 11B in the present embodiment is a single-strip LED light strip.

Embodiment 4

Figure 12:
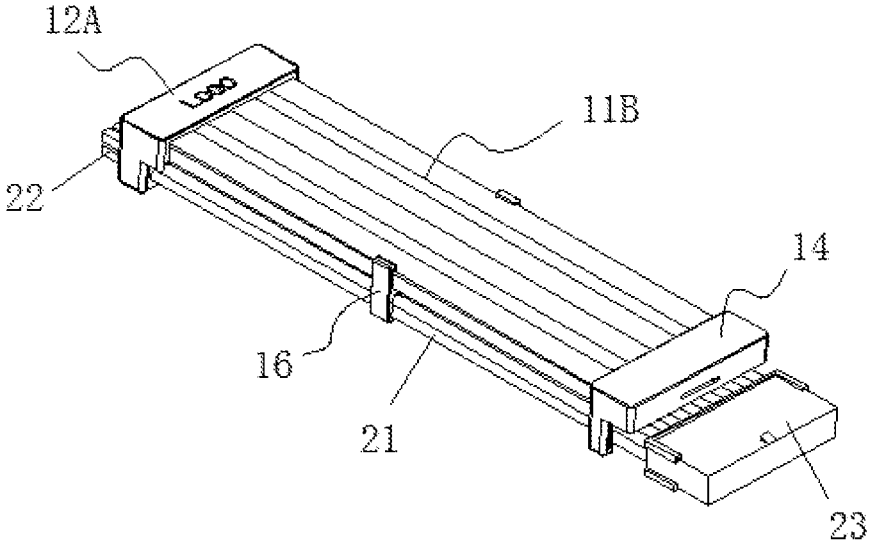
FIG. 12 is a schematic diagram showing a structure of a second light-emitting connecting line.

Reference is made to FIG. 12, the embodiment 4 of the present invention provides a light-emitting connecting line including a group of connecting harness 2 and the light emitting device 1B in the above-mentioned embodiment 3. The structure of the light-emitting connecting line in the present embodiment 4 is almost the same as the structure of the light-emitting connecting line in the above-mentioned embodiment 2, except that the light emitting device 1A is replaced with the light emitting device 1B.

Embodiment 5

Figure 13:
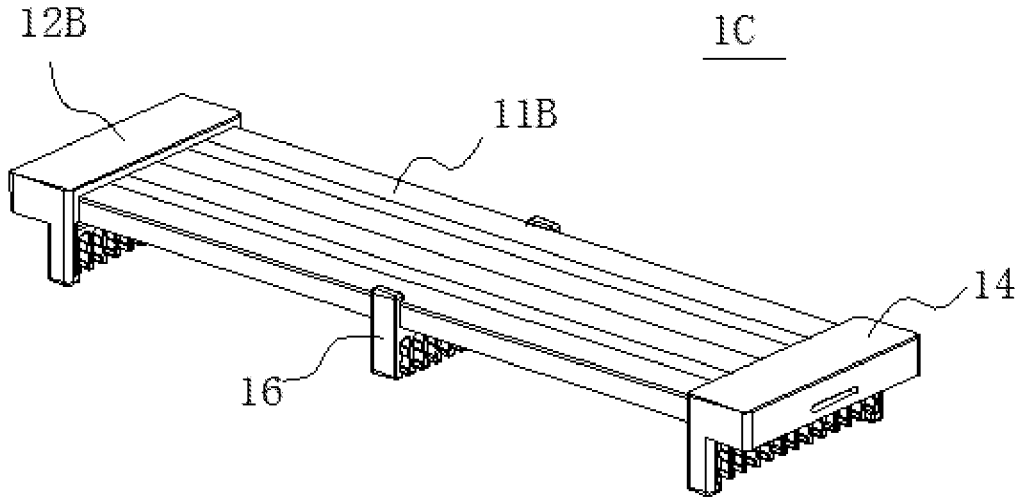
FIG. 13 is a first schematic diagram showing a structure of a third light emitting device.
Figure 14:
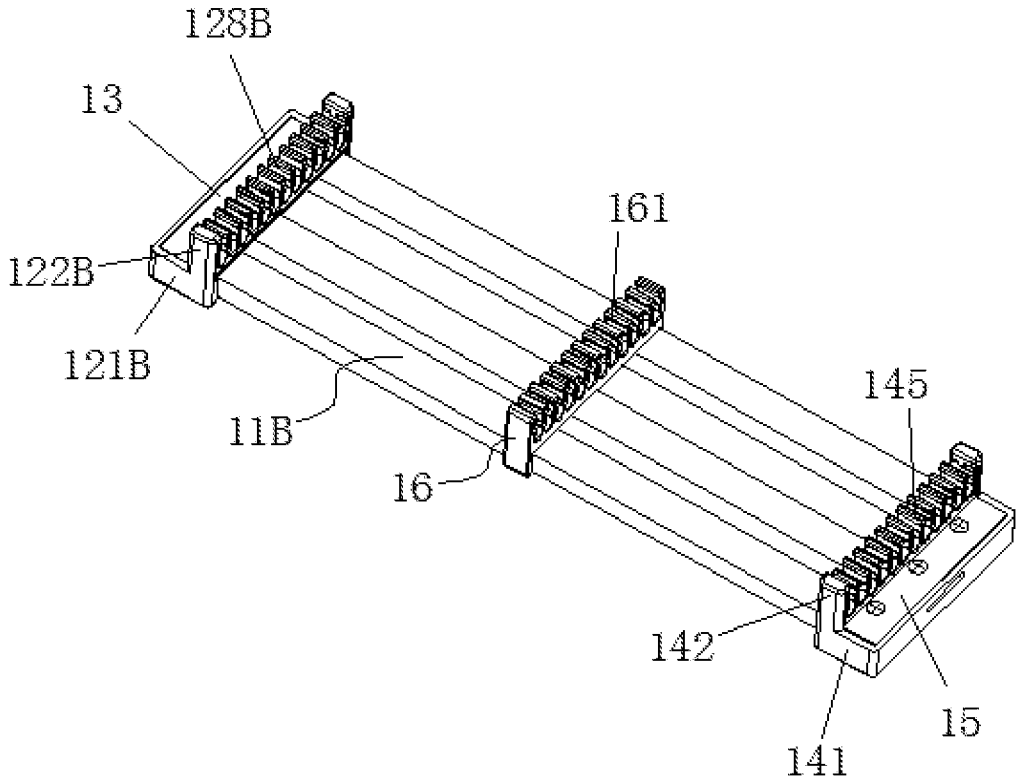
FIG. 14 is a second schematic diagram showing the structure of the third light emitting device.

Reference is made to FIG. 13 and FIG. 14, the embodiment 5 of the present invention provides a light emitting device 1C including components such as an LED light strip 11B, a first clamping seat 12B, a first light strip fixing pressing sheet 13, a second clamping seat 14 and a second light strip fixing pressing sheet 15. The structure of the light emitting device 1C in the present embodiment 5 is almost the same as the structure of the light emitting device 1B in the above-mentioned embodiment 3, except that the first clamping seat 12A is replaced with the first clamping seat 12B.

Figure 15:
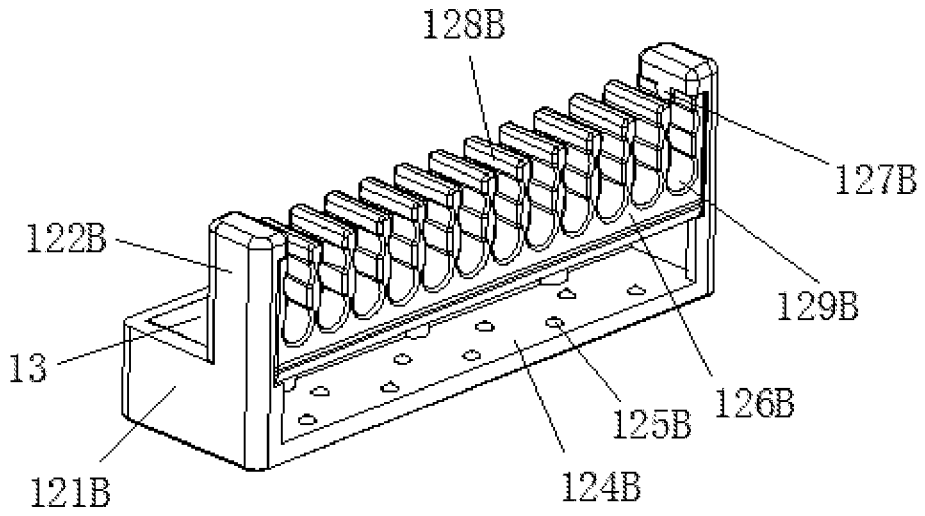
FIG. 15 is a schematic diagram showing a structure of a part at one end of the third light emitting device.
Figure 16:
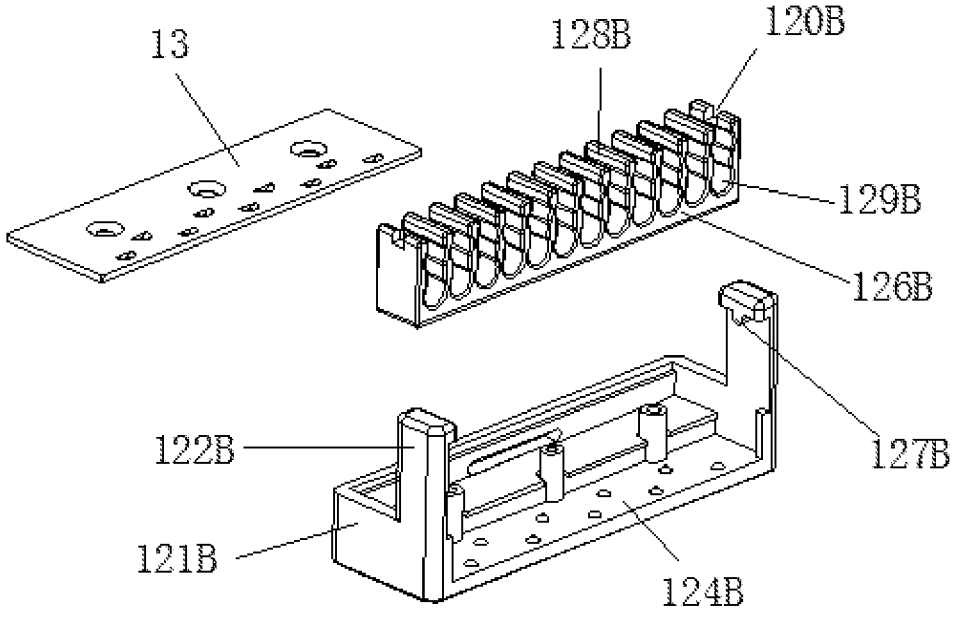
FIG. 16 is an exploded view showing a part at one end of the third light emitting device.

As shown in FIG. 14, FIG. 15 and FIG. 16, the first clamping seat 12B includes a first clamping seat body 121B, first clamping seat buckling legs 122B and a first line splitting and clamping device 126B used for clamping cables 21 of a connecting harness 2, the first clamping seat buckling legs 122B are connected to the bottoms of two sides of the first clamping seat body 121B, the inner surface of each of the first clamping seat buckling legs 122B is provided with a first clamping position 127B, the lower end of the first line splitting and clamping device 126B is provided with several first line clamping blocks 128B arranged in a length direction of the first line splitting and clamping device, a first line clamping slot 129B for clamping the cables 21 of the connecting harness 2 is formed between every two of the adjacent first line clamping blocks 128B, a first clamping position slot 120B is formed in the bottom of each of the second line clamping blocks 128B at two sides of the first line splitting and clamping device 126B, and the first clamping positions 127B of the first clamping seat buckling legs 122B are clamped into the corresponding first clamping position slots 120B, so that the first line splitting and clamping device 126B is mounted between the two first clamping seat buckling legs 122B and is located on the back of the LED light strip 11B.

In the present embodiment, the first line clamping slot 129B consists of two groups of slot positions (such as a C-shaped slot) so as to adapt to the cables 21, arranged up and down in two rows, of the connecting harness 2. Of course, the slot positions of the first line clamping slot 129B may be adjusted according to the number of the cables of the connecting harness 2.

A first light strip insertion slot 124B is formed in a part, facing one end of the LED light strip 11B, of the first clamping seat body 121B, and one end of the LED light strip 11A is inserted to the inside of the first clamping seat body 121B from the first light strip insertion slot 124B. In addition, the inner top wall of the first clamping seat 12B may also be provided with several second line pressing convex bodies 125B which are downwards raised as in the case of the first clamping seat 12A.

Embodiment 6

Figure 17:
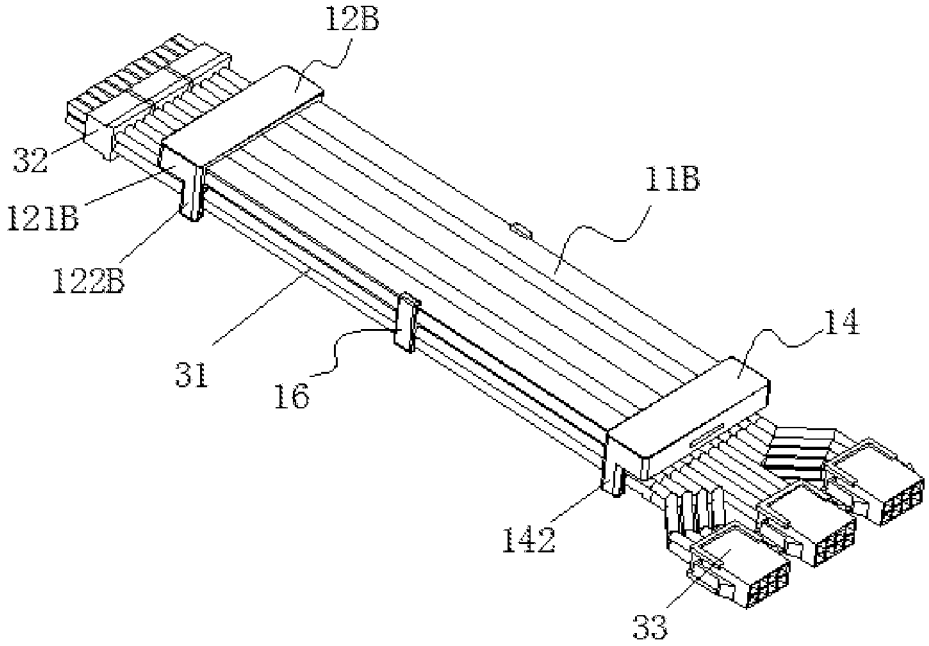
FIG. 17 is a first schematic diagram showing a structure of a third light-emitting connecting line.
Figure 18:
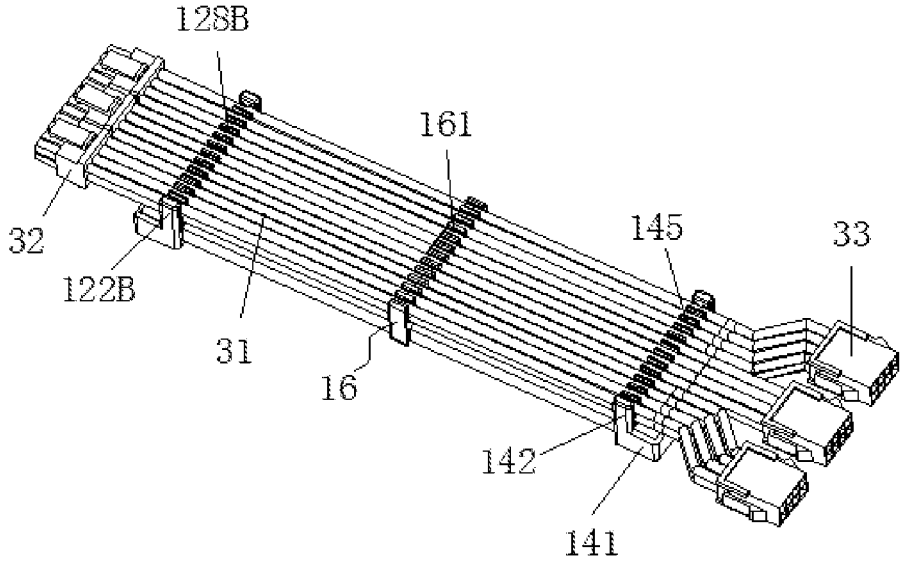
FIG. 18 is a second schematic diagram showing the structure of the third light-emitting connecting line.

Reference is made to FIG. 17 and FIG. 18, the embodiment 6 of the present invention provides a light-emitting connecting line including three groups of connecting harnesses 3 which are juxtaposed together and the light emitting device 1C in the above-mentioned embodiment 5. Each group of connecting harness 3 may include a plug 32, a plug 33 and several cables 31, and the plug 32 and the plug 33 are respectively connected to two ends of the cables 31.

The first line splitting and clamping device 126B of the first clamping seat 12B of the light emitting device 1C is clamped on one end of the cables 31 of the three groups of connecting harnesses 2 at the same time, and the second line splitting and clamping device 143 of the second clamping seat 14 of the light emitting device 1C is clamped on the other ends of the cables 31 of the three groups of connecting harnesses 2 at the same time.

Of course, the light emitting device 1C may also be clamped on single group of connecting harness 3 according to an actual demand. In addition, in other embodiments, the LED light strip 11B of the light emitting device 1C may also be replaced with the combined LED light strip 11A. Herein, it should be noted that the above-mentioned terms such as "first", "second" and "third" do not limit the order and quantity, but are merely used to distinguish different components.

The above-mentioned embodiments are preferred implementation manners of the present invention, however, the implementation manners of the present invention are not limited by the above-mentioned embodiments, any other changes, modifications, replacements, combinations and simplifications made without departing from the spirit essence and principle of the present invention shall fall within the protection scope of the present invention.

The invention claimed is:

1. A light emitting device, comprising:

an LED light strip used for emitting light after being energized;

a first clamping seat, wherein a first light strip insertion slot is formed in a part, facing one end of the LED light strip, of the first clamping seat, and one end of the LED light strip is inserted to the inside of the first clamping seat from the first light strip insertion slot;

a first light strip fixing pressing sheet, wherein the first light strip fixing pressing sheet is locked on the first clamping seat by using a first screw and is located on the back of the LED light strip, and the first light strip fixing pressing sheet is matched with the inner top wall of the first clamping seat to tightly press one end of the LED light strip, so that one end of the LED light strip is fixedly connected with the first clamping seat;

a second clamping seat, wherein a second light strip insertion slot is formed in a part, facing one end of the LED light strip, of the second clamping seat, and the other end of the LED light strip is inserted to the inside of the second clamping seat from the second light strip insertion slot; and a second light strip fixing pressing sheet, wherein the second light strip fixing pressing sheet is locked on the second clamping seat by using a second screw and is located on the back of the LED light strip, and the second light strip fixing pressing sheet is matched with the inner top wall of the second clamping seat to tightly press the other end of the LED light strip, so that the other end of the LED light strip is fixedly connected with the second clamping seat.

2. The light emitting device of claim 1, wherein the inward surface of the first light strip fixing pressing sheet is provided with several first line pressing convex bodies which are upwards raised, the inner top wall of the first clamping seat is provided with several second line pressing convex bodies which are downwards raised; and the inward surface of the second light strip fixing pressing sheet is provided with several third line pressing convex bodies which are upwards raised, the inner top wall of the second clamping seat is provided with several fourth line pressing convex bodies which are downwards raised.

3. The light emitting device of claim 1, wherein the first clamping seat comprises a first clamping seat body and first clamping seat buckling legs, the first clamping seat buckling legs are connected to the bottoms of two sides of the first clamping seat body, and the inner surface of each of the first clamping seat buckling legs is provided with a buckling position buckled with one of plugs of a connecting harness.

4. The light emitting device of claim 1, wherein the first clamping seat comprises a first clamping seat body, first clamping seat buckling legs and a first line splitting and clamping device for clamping cables of a connecting harness, wherein the first clamping seat buckling legs are connected to the bottoms of two sides of the first clamping seat body, the inner surface of each of the first clamping seat buckling legs is provided with a first clamping position, the lower end of the first line splitting and clamping device is provided with several first line clamping blocks arranged in a length direction of the first line splitting and clamping device, a first line clamping slot for clamping the cables of the connecting harness is formed between every two of the adjacent first line clamping blocks, a first clamping position slot is formed in the bottom of each of the first line clamping blocks at two sides of the first line splitting and clamping device, and the first clamping positions of the first clamping seat buckling legs are clamped into the corresponding first clamping position slots, so that the first line splitting and clamping device is mounted between the two first clamping seat buckling legs and is located on the back of the LED light strip.

5. The light emitting device of claim 1, wherein the second clamping seat comprises a second clamping seat body, second clamping seat buckling legs and a second line splitting and clamping device for clamping cables of a connecting harness, wherein the second clamping seat buckling legs are connected to the bottoms of two sides of the second clamping seat body, the inner surface of each of the second clamping seat buckling legs is provided with a second clamping position, the lower end of the second line splitting and clamping device is provided with several second line clamping blocks arranged in a length direction of the second line splitting and clamping device, a second line clamping slot for clamping the cables of the connecting harness is formed between every two of the adjacent second line clamping blocks, a second clamping position slot is formed in the bottom of each of the second line clamping blocks at two sides of the second line splitting and clamping device, and the second clamping positions of the second clamping seat buckling legs are clamped into the corresponding second clamping position slots, so that the second line splitting and clamping device is mounted between the two second clamping seat buckling legs and is located on the back of the LED light strip.

6. The light emitting device of claim 1, wherein a circuit board is arranged in the second clamping seat, a connection point of the LED light strip is electrically connected with the circuit board, a wire protrusion opening is formed in the surface of the end, away from the LED light strip, of the second clamping seat, and the circuit board is connected with a wire protruding out of the wire protrusion opening of the second clamping seat.

7. The light emitting device of claim 1, further comprising a middle line splitting and clamping device located on the back of the LED light strip, wherein the lower end of the middle line splitting and clamping device is provided with several third line clamping blocks arranged in a length direction of the middle line splitting and clamping device, a third line clamping slot for clamping cables of a connecting harness is formed between every two of the adjacent third line clamping blocks, hanging buckles are respectively arranged on two sides of the upper end of the middle line splitting and clamping device, and the hanging buckles on the two sides of the middle line splitting and clamping device are movably buckled on two sides of the top of the LED light strip.

8. The light emitting device of claim 1, wherein at least one LED light strip is provided, the LED light strip is set as a square silicon light strip.

9. The light emitting device of claim 8, wherein each LED light strip comprises a light strip housing, at least one light conductor and at least one light strip flexible circuit board with an LED wick, the light strip flexible circuit board is located inside the light strip housing, the light conductor is connected with the light strip housing and covers the outside of the light strip flexible circuit board, and a light shielding strip facing the light strip flexible circuit board is arranged outside the light conductor.

10. A light-emitting connecting line, comprising at least one group of connecting harness and a light emitting device, wherein the connecting harness comprises plugs and several cables, the plugs are connected to two ends of the cables;

the light emitting device comprising:

an LED light strip used for emitting light after being energized;

a first clamping seat, wherein a first light strip insertion slot is formed in a part, facing one end of the LED light strip, of the first clamping seat, and one end of the LED light strip is inserted to the inside of the first clamping seat from the first light strip insertion slot;

a first light strip fixing pressing sheet, wherein the first light strip fixing pressing sheet is locked on the first clamping seat by using a first screw and is located on the back of the LED light strip, and the first light strip fixing pressing sheet is matched with the inner top wall of the first clamping seat to tightly press one end of the LED light strip, so that one end of the LED light strip is fixedly connected with the first clamping seat;

a second clamping seat, wherein a second light strip insertion slot is formed in a part, facing one end of the LED light strip, of the second clamping seat, and the other end of the LED light strip is inserted to the inside of the second clamping seat from the second light strip insertion slot; and a second light strip fixing pressing sheet, wherein the second light strip fixing pressing sheet is locked on the second clamping seat by using a second screw and is located on the back of the LED light strip, and the second light strip fixing pressing sheet is matched with the inner top wall of the second clamping seat to tightly press the other end of the LED light strip, so that the other end of the LED light strip is fixedly connected with the second clamping seat;

a first clamping seat of the light emitting device is clamped on one of the plugs of the connecting harness or one end of the cables of the connecting harness, and a second clamping seat of the light emitting device is clamped on the other ends of the cables of the connecting harness.

11. The light-emitting connecting line of claim 10, wherein the inward surface of the first light strip fixing pressing sheet is provided with several first line pressing convex bodies which are upwards raised, the inner top wall of the first clamping seat is provided with several second line pressing convex bodies which are downwards raised; and the inward surface of the second light strip fixing pressing sheet is provided with several third line pressing convex bodies which are upwards raised, the inner top wall of the second clamping seat is provided with several fourth line pressing convex bodies which are downwards raised.

12. The light-emitting connecting line of claim 10, wherein the first clamping seat comprises a first clamping seat body and first clamping seat buckling legs, the first clamping seat buckling legs are connected to the bottoms of two sides of the first clamping seat body, and the inner surface of each of the first clamping seat buckling legs is provided with a buckling position buckled with one of the plugs of the connecting harness.

13. The light-emitting connecting line of claim 10, wherein the first clamping seat comprises a first clamping seat body, first clamping seat buckling legs and a first line splitting and clamping device for clamping the cables of the connecting harness, wherein the first clamping seat buckling legs are connected to the bottoms of two sides of the first clamping seat body, the inner surface of each of the first clamping seat buckling legs is provided with a first clamping position, the lower end of the first line splitting and clamping device is provided with several first line clamping blocks arranged in a length direction of the first line splitting and clamping device, a first line clamping slot for clamping the cables of the connecting harness is formed between every two of the adjacent first line clamping blocks, a first clamping position slot is formed in the bottom of each of the first line clamping blocks at two sides of the first line splitting and clamping device, and the first clamping positions of the first clamping seat buckling legs are clamped into the corresponding first clamping position slots, so that the first line splitting and clamping device is mounted between the two first clamping seat buckling legs and is located on the back of the LED light strip.

14. The light-emitting connecting line of claim 10, wherein the second clamping seat comprises a second clamping seat body, second clamping seat buckling legs and a second line splitting and clamping device for clamping the cables of the connecting harness, wherein the second clamping seat buckling legs are connected to the bottoms of two sides of the second clamping seat body, the inner surface of each of the second clamping seat buckling legs is provided with a second clamping position, the lower end of the second line splitting and clamping device is provided with several second line clamping blocks arranged in a length direction of the second line splitting and clamping device, a second line clamping slot for clamping the cables of the connecting harness is formed between every two of the adjacent second line clamping blocks, a second clamping position slot is formed in the bottom of each of the second line clamping blocks at two sides of the second line splitting and clamping device, and the second clamping positions of the second clamping seat buckling legs are clamped into the corresponding second clamping position slots, so that the second line splitting and clamping device is mounted between the two second clamping seat buckling legs and is located on the back of the LED light strip.

15. The light-emitting connecting line of claim 10, wherein a circuit board is arranged in the second clamping seat, a connection point of the LED light strip is electrically connected with the circuit board, a wire protrusion opening is formed in the surface of the end, away from the LED light strip, of the second clamping seat, and the circuit board is connected with a wire protruding out of the wire protrusion opening of the second clamping seat.

16. The light-emitting connecting line of claim 10, further comprising a middle line splitting and clamping device located on the back of the LED light strip, wherein the lower end of the middle line splitting and clamping device is provided with several third line clamping blocks arranged in a length direction of the middle line splitting and clamping device, a third line clamping slot for clamping the cables of the connecting harness is formed between every two of the adjacent third line clamping blocks, hanging buckles are respectively arranged on two sides of the upper end of the middle line splitting and clamping device, and the hanging buckles on the two sides of the middle line splitting and clamping device are movably buckled on two sides of the top of the LED light strip.

17. The light-emitting connecting line of claim 10, wherein at least one LED light strip is provided, the LED light strip is set as a square silicon light strip.

18. The light-emitting connecting line of claim 17, wherein each LED light strip comprises a light strip housing, at least one light conductor and at least one light strip flexible circuit board with an LED wick, the light strip flexible circuit board is located inside the light strip housing, the light conductor is connected with the light strip housing and covers the outside of the light strip flexible circuit board, and a light shielding strip facing the light strip flexible circuit board is arranged outside the light conductor.

19. The light-emitting connecting line of claim 10, wherein the connecting harness is provided with the cables arranged up and down in two rows, and the cables are set as cables with silicon outer layers.

* * * * *